US008217886B2

(12) United States Patent
Lan et al.

(10) Patent No.: US 8,217,886 B2
(45) Date of Patent: Jul. 10, 2012

(54) LIQUID CRYSTAL DISPLAYS CAPABLE OF INCREASING CHARGE TIME AND METHODS OF DRIVING THE SAME

(75) Inventors: Tung-Hsin Lan, Taipei (TW); Mu-Shan Liao, Taoyuan County (TW); Tien-Yung Huang, Pingtung County (TW); Chia-Chun Fang, Kaohsiung (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 516 days.

(21) Appl. No.: 12/413,588

(22) Filed: Mar. 29, 2009

(65) Prior Publication Data

US 2010/0182297 A1 Jul. 22, 2010

(30) Foreign Application Priority Data

Jan. 22, 2009 (TW) ..... 98102486 A

(51) Int. Cl.
*G09G 3/36* (2006.01)

(52) U.S. Cl. ..... 345/100; 345/87

(58) Field of Classification Search ..... 345/87–100, 345/204, 211

See application file for complete search history.

(56) References Cited

U.S. PATENT DOCUMENTS

| | | | | |
|---|---|---|---|---|
| 2007/0171176 | A1* | 7/2007 | Kwon et al. | 345/100 |
| 2008/0007504 | A1* | 1/2008 | Kawaura et al. | 345/89 |
| 2008/0094342 | A1* | 4/2008 | Kim | 345/99 |
| 2009/0160749 | A1* | 6/2009 | Lee | 345/95 |
| 2010/0073335 | A1* | 3/2010 | Min et al. | 345/204 |
| 2010/0225620 | A1* | 9/2010 | Lee | 345/204 |
| 2011/0175858 | A1* | 7/2011 | Lee et al. | 345/204 |

FOREIGN PATENT DOCUMENTS

| | | | |
|---|---|---|---|
| CN | 101206362 | A | 6/2008 |
| CN | 101226290 | A | 7/2008 |
| CN | 101226290(A) | * | 7/2008 |

* cited by examiner

*Primary Examiner* — Nitin Patel
(74) *Attorney, Agent, or Firm* — Winston Hsu; Scott Margo

(57) ABSTRACT

An LCD device includes a plurality of first data lines, a plurality of second data lines, a plurality of display units, a source driver and a gate driver. Each of the second data lines is disposed between two corresponding first data lines, while each display unit is coupled to a corresponding first data line and a corresponding gate line or to a corresponding second data line and a corresponding gate line. The source driver is coupled to the plurality of first data lines and the plurality of second data lines for providing a plurality of data signals. Each of the data signals is outputted to a corresponding first data line during a first period in a write period, and outputted to a corresponding second data line during a second period in the write period.

5 Claims, 5 Drawing Sheets

LIQUID CRYSTAL DISPLAYS CAPABLE OF INCREASING CHARGE TIME AND METHODS OF DRIVING THE SAME

BACKGROUND OF THE INVENTION

1. Field of the Invention

The present invention is related to a liquid crystal display device and a related driving method, and more particularly, to a liquid crystal display device capable of increasing charge time and a related driving method.

2. Description of the Prior Art

Liquid crystal display (LCD) devices, characterized in low radiation, small size and low power consumption, have gradually replaced traditional cathode ray tube (CRT) devices and widely applied in electronic devices, such as notebook computers, personal digital assistants (PDAs), flat panel TVs or mobile phones.

In order to design an LCD device having low power consumption, it needs to be noted that panel loading and dynamic power consumption both increase with the panel size. Normally, the polarity of the voltages applied to the liquid crystal capacitors need to be inverted at a predetermined interval to avoid permanent damage caused by the polarization of liquid crystal material. Common driving methods includes dot inversion, line inversion and frame inversion. The LCD device has the heaviest loading when the polarity of the driving voltage begins to invert and the source driver is required to provide large amount of power to change the voltages of the data lines. Meanwhile, the charge time of the liquid crystal capacitors becomes shorter with the increase in operating frequency and panel resolution. If two driving voltages vary a lot, the ideal voltage level may not be obtained after polarity inversion due to insufficient charge time. Therefore, precharge is commonly employed for improving charge time.

Reference is made to FIG. 1 for a prior art LCD device 10. The LCD device 10 includes an LCD panel 12, a source driver 14, and two gate drivers 16 and 18. A plurality of parallel data lines $DL_1$-$DL_m$, a plurality of parallel gate lines $GL_1$-$GL_n$, and a plurality of display units P(1,1)-P(m,n) are disposed on the LCD panel 12. The data lines $DL_1$-$DL_m$ and the gate lines $GL_1$-$GL_n$ form a matrix, and the display units P(1,1)-P(m,n) are disposed on the locations where the corresponding data lines and the corresponding gate lines intersect. Each display unit disposed on the LCD panel 12 includes a TFT switch and a liquid crystal capacitor. Each liquid crystal capacitor is coupled to a corresponding data line via a corresponding TFT switch. The source driver 14 can generate data signals corresponding to display images, while the gate drivers 16 and 18 can generate gate signals for turning on the TFT switches. When the TFT switch of a display unit is turned on by a gate signal, the liquid crystal capacitor of the display unit can be electrically connected to a corresponding data line for receiving the data signal transmitted from the source driver 14. Based on the charges stored in the liquid crystal capacitors (the polarity of the stored charge is represented by "+" or "−"), the display units can display images of different gray scales by rotating liquid crystal molecules.

Reference is made to FIG. 2 for a timing diagram illustrating the operations of the prior art LCD device 10. In FIG. 2, the horizontal axis represents time and the vertical axis represents voltage level. CK_O, CKB_O and STV_O represent the clock signals and start pulse signals for operating the gate driver 16, while CK_E, CKB_E and STV_E represent the clock signals and start pulse signals for operating the gate driver 18. GS1-GS4 respectively represent the gate signals outputted to the gate lines $GL_1$-$GL_4$. DATA represents data signals, and DATA1-DATA4 respectively represent the data signals outputted to the same data line. T represents the operating period of the LCD device 10, A1-A4 represent normal charge periods, and P1-P4 represent precharge periods. When inputting the data signal DATA1, the gate signals GS1 and GS2 are both at high level, during which the pixel P(1,1) is in normal charge period and the pixel P(1,2) is in precharge period. In other words, the pixel P(1,2) is first precharged with the data signal DATA1 previously written into the pixel P(1,1). The correct data signal DATA2 is then written into the pixel P(1,2) during the subsequent normal charge period A2.

The prior art LCD device 10 can increase the charge time of the TFT switches (from T/4 to T/2) by precharging the display units. However, the effect of precharge is limited when the correct data signal of a data line differs a lot from the precharge data signal. Also, the LCD device 10 can provide line inversion or frame inversion, but is unable to achieve higher display quality of dot inversion.

SUMMARY OF THE INVENTION

The present invention provides a liquid crystal display device capable of increasing charge time, comprising m first data lines disposed in parallel; m second data lines disposed in parallel, wherein each second data line is disposed between two corresponding first data lines and parallel to the corresponding first data lines; a plurality of parallel gate lines disposed perpendicular to the m first data lines and the m second data lines for receiving gate signals; a plurality of first display units each coupled to a corresponding first data line among the m first data lines and to a corresponding gate line among the plurality of gate lines; a plurality of second display units each coupled to a corresponding second data line among the m second data lines and to a corresponding gate line among the plurality of gate lines; and a source driver coupled to the m first data lines and the m second data lines for providing m data signals, wherein each data signal is outputted to a corresponding first data line among the m first data lines during a first period of a write period, and outputted to a corresponding second data line among the m second data lines during a second period of the write period.

The present invention also provides a method for driving an LCD device, comprising respectively outputting m data signals to m corresponding first data lines during a first period of a write period; and respectively outputting the m data signals to m corresponding second data lines during a second period of the write period and discontinuing outputting the m data signals to the m first data lines, wherein the m corresponding second data lines are respectively adjacent to the m first data lines.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
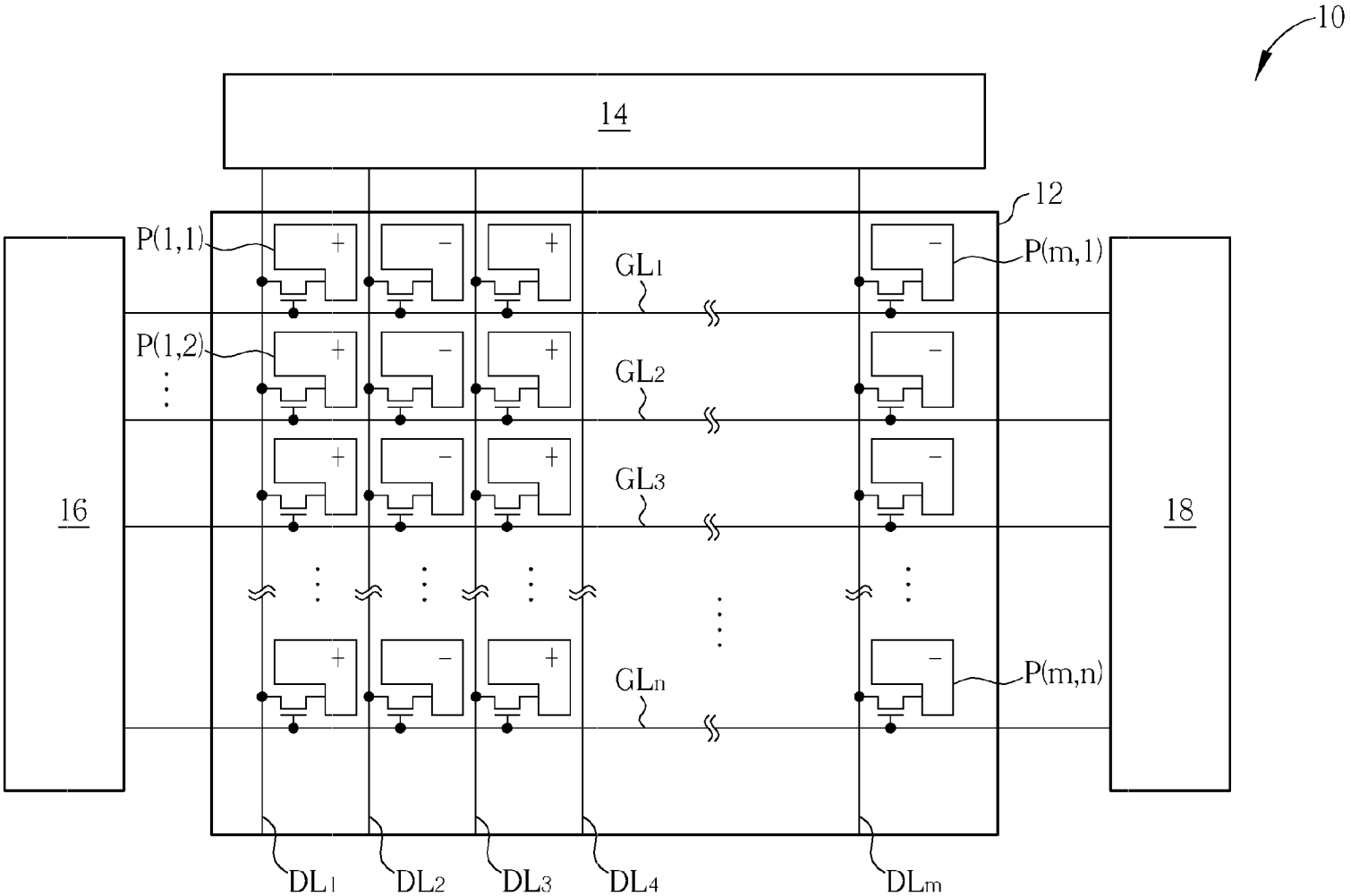
FIG. 1 PRIOR ART
FIG. 1 is a diagram illustrating a prior art LCD device.
Figure 2:
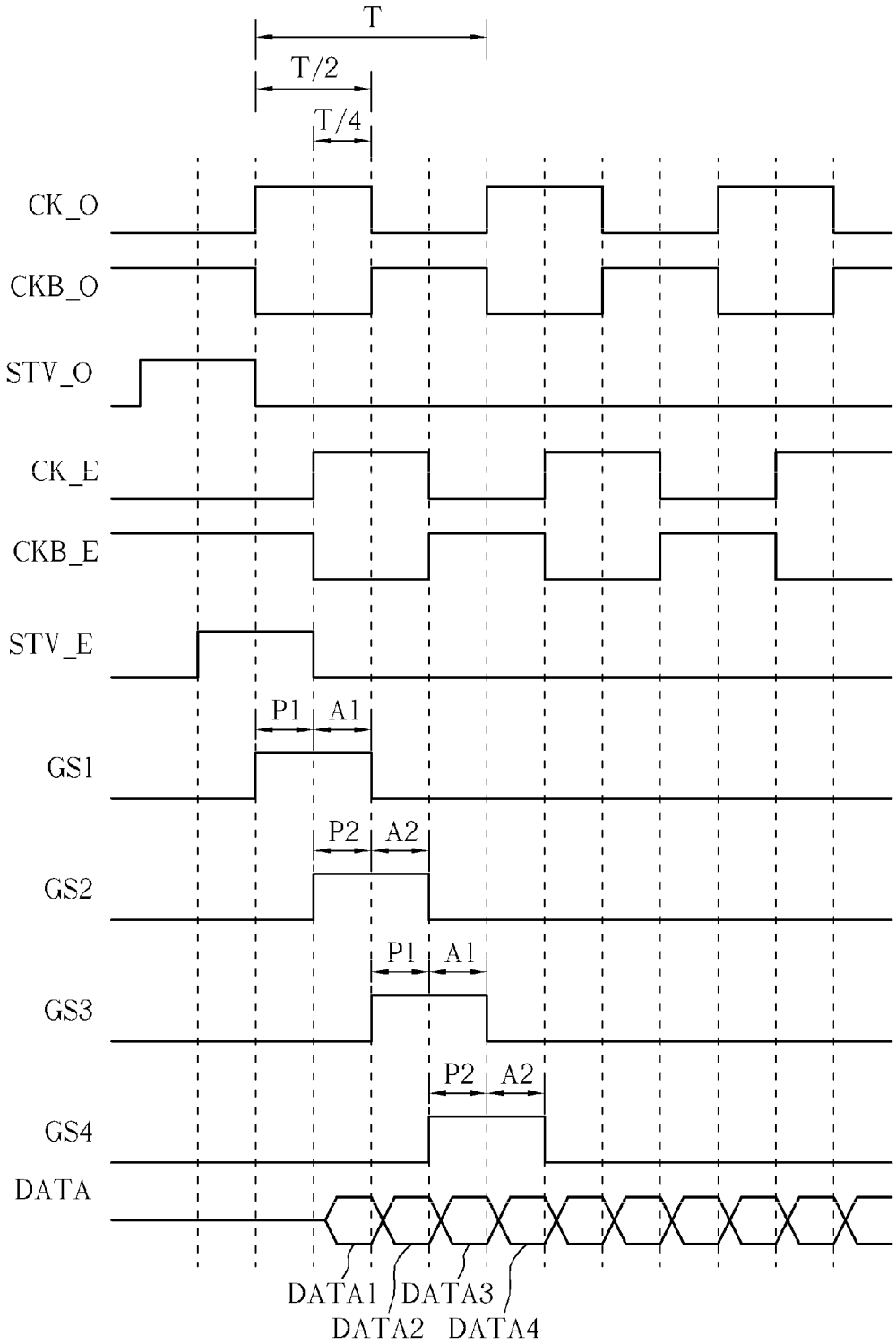
FIG. 2 PRIOR ART
FIG. 2 is a timing diagram illustrating the operations of the prior art LCD device in FIG. 1.
Figure 3:
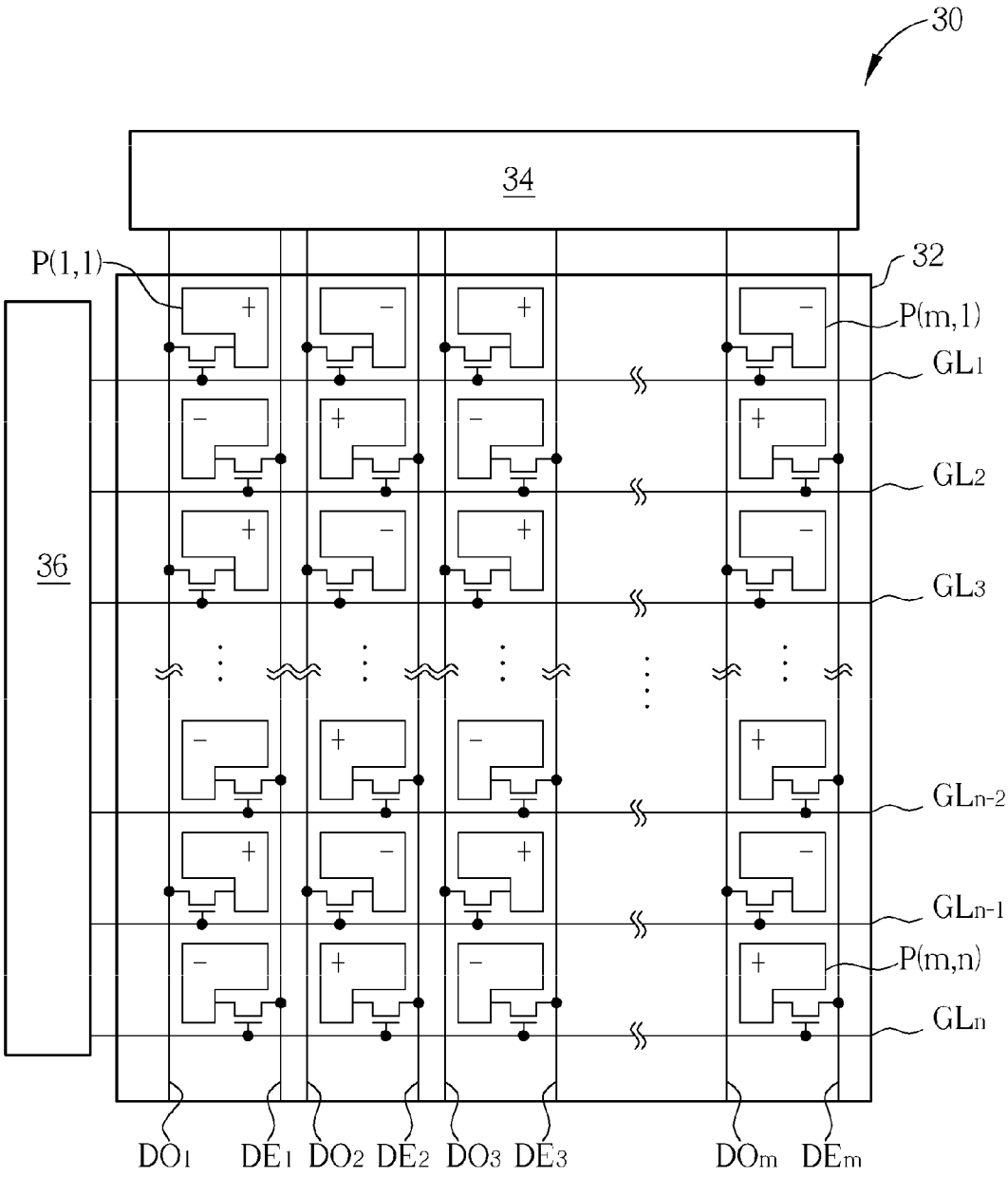
FIG. 3 is a diagram illustrating an LCD device according to the present invention.

Reference is made to FIG. 3 for an LCD device 30 according to the present invention. The LCD device 30 includes an LCD panel 32, a source driver 34, and a gate driver 36. A plurality of parallel data lines, a plurality of parallel gate lines $GL_1$-$GL_n$, and a plurality of display units P(1,1)-P(m,n) are disposed on the LCD panel 32. $DO_1$-$DO_m$ represent odd-numbered data lines, while $DE_1$-$DE_m$ represent even-numbered data lines. Each display unit disposed on the LCD panel 32 includes a TFT switch and a liquid crystal capacitor. Each liquid crystal capacitor is coupled to a corresponding data line via a corresponding TFT switch. The source driver 34 can generate data signals corresponding to display images, while the gate driver 36 can generate gate signals for turning on the TFT switches. When the TFT switch of a display unit is turned on by a gate signal, the liquid crystal capacitor of the display unit can be electrically connected to a corresponding data line for receiving the data signal transmitted from the source driver 34. Based on the charges stored in the liquid crystal capacitors (the polarity of the stored charge is represented by "+" or "−"), the display units can display images of different gray scales by rotating liquid crystal molecules.

In the LCD device 30 of the present invention, the data lines and the gate lines form a matrix, but the display units P(1,1)-P(m,n) are only disposed on the locations where the corresponding odd-numbered data lines and the corresponding odd-numbered gate lines intersect, or where the corresponding even-numbered data lines and the corresponding even-numbered gate lines intersect. In other words, (n/2) display units (suppose n is an even integer) are disposed on each data line, while n display units are disposed on each gate line. Therefore, (m*n) display units are disposed on the LCD panel 32. For example, the locations where the display units P(1,1)-P(m,n) are disposed include the (n/2) intersections of the odd-numbered data line $DO_1$ and the odd-numbered gate lines $GL_1$-$GL_{n-1}$, or the (n/2) intersections of the even-numbered data line $DE_1$ and the even-numbered gate lines $GL_2$-$GL_n$.

The source driver 34 of the present invention can achieve dot inversion display effect based on line inversion structure. For example, by outputting data signals having a positive polarity (represented by "+" in FIG. 3) via the odd-numbered data lines $DO_1$-$DO_m$ and outputting data signals having a negative polarity (represented by "−" in FIG. 3) via the even-numbered data lines $DE_1$-$DE_m$, each display unit on the LCD panel 32 has a polarity opposite to that of its neighboring display units.

Figure 4:
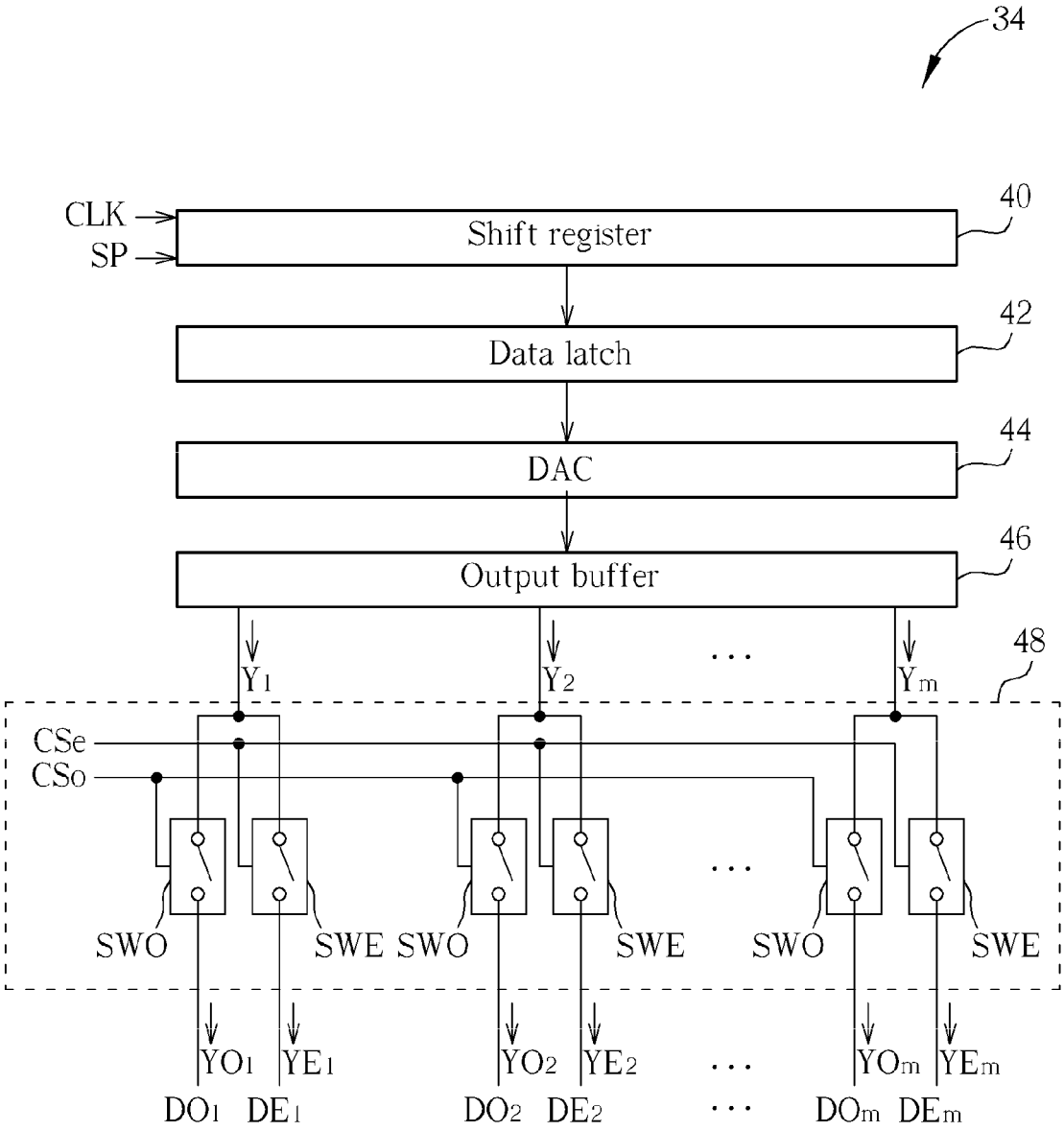
FIG. 4 is a diagram illustrating of the source driver according to the present invention.

Reference is made to FIG. 4 for a diagram of the source driver 34 according to the present invention. The source driver 34 includes a shift register 40, a data latch 42, a digital-to-analog converter (DAC) 44, an output buffer 46, and a switch control circuit 48. Based on a clock signal CLK and a start pulse signal SP, the shift register 40 can generate a corresponding clock control signal. By latching the input data signal base on the clock control signal, the data latch 42 can generate corresponding sample data signals. The DAC 44 can converter the sample data signals to analog data signals, which are then outputted via the output buffer 46 as the corresponding data signals Y1-Ym. The switch control circuit 48, coupled to the odd-numbered data lines $DO_1$-$DO_m$ and the even-numbered data lines $DE_1$-$DE_m$, can control the signal path between the m data signals Y1-Ym and the data lines. The data signals received by the odd-numbered data lines $DO_1$-$DO_m$ are respectively represented by YO1-YOm, while the data signals received by the even-numbered data lines $DE_1$-$DE_m$ are respectively represented by YE1-YEm.

The switch control circuit 48 includes m odd-numbered switches SWO operative based on the control signal CSo and m even-numbered switches SWE operative based on the control signal CSe, wherein the control signals CSo and CSe are periodic signals having a 180° phase difference. The odd-numbered switches SWO and the even-numbered switches SWE can include transistor switches or other devices having similar function. The switch control circuit 48 includes m input ends and 2 m output ends. Each input end is coupled to two output ends via a corresponding odd-numbered switch and a corresponding even-numbered switch. For example, when the control signal CSo is at high level and the control signal CSe is at low level, the odd-numbered switches SWO are turned on and the even-numbered switches SWE are turned off. Thus, the switch control circuit 48 transmits data signals Y1-Ym to the odd-numbered data lines $DO_1$-$DO_m$. Similarly, when the control signal CSo is at low level and the control signal CSe is at high level, the odd-numbered switches SWO are turned off and the even-numbered switches SWE are turned on. Thus, the switch control circuit 48 transmits data signals Y1-Ym to the even-numbered data lines $DE_1$-$DE_m$.

Figure 5:
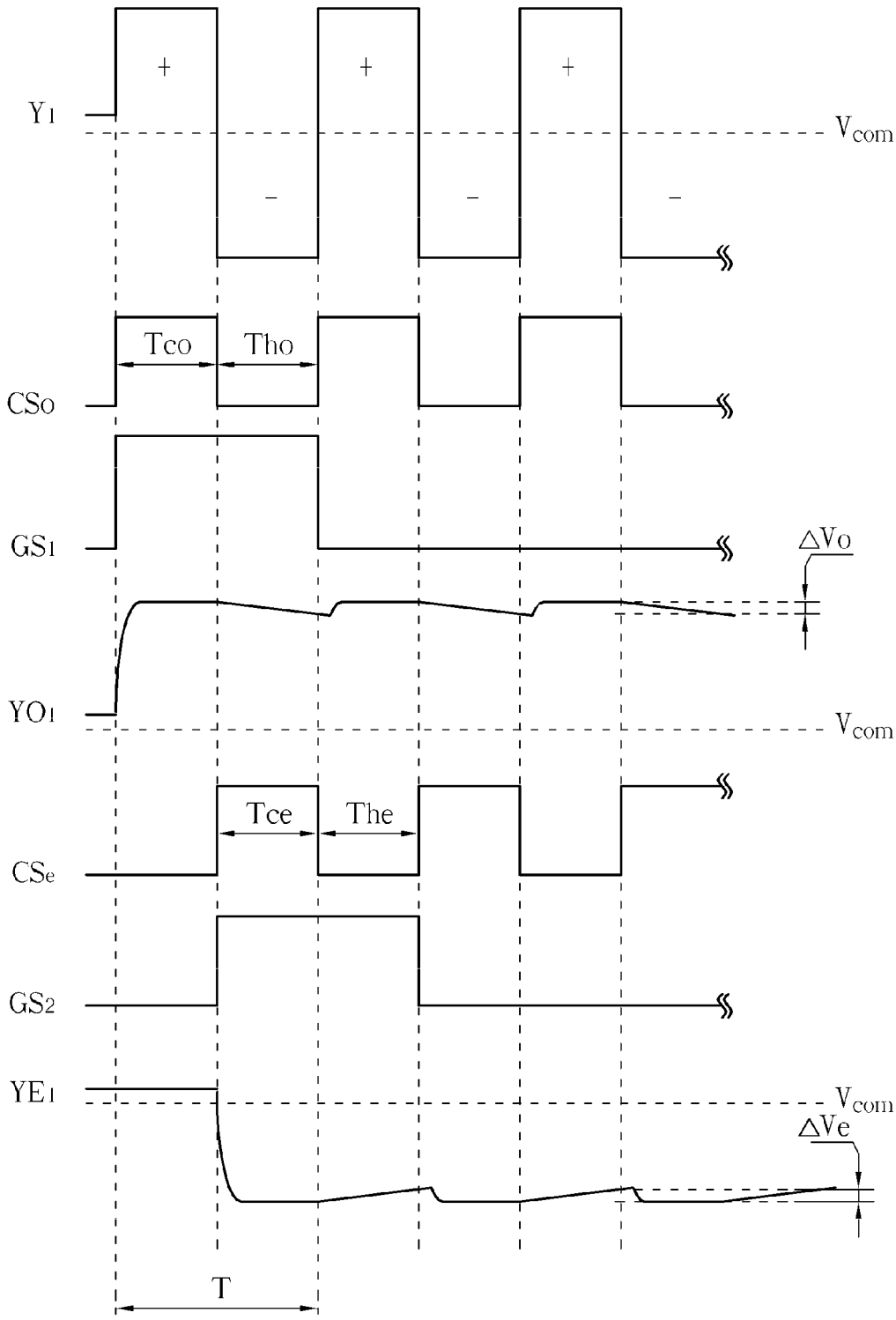
FIG. 5 is a timing diagram illustrating the operations of the LCD device 30 in FIG. 3.

Reference is made to FIG. 5 for a timing diagram illustrating the operations of the LCD device 30 according to the present invention. In FIG. 5, the horizontal axis represents time, the vertical axis represents voltage level, and the first data signal Y1 of the output buffer 46 is used for illustration. The period T of the data signal Y1 includes a positive polarity driving period (indicated by "+" in FIG. 5) and a negative polarity driving period (indicated by "−" in FIG. 5). YO1 and YE1 respectively represent the data signals received by the data lines $DO_1$ and $DE_1$, while GS1 and GS2 respectively represent the driving waveforms of the gate lines. CSo and CSe represent switch control signals, and $V_{com}$ represents the common voltage. The write period of the data line $DO_1$ includes a charge period Tco and a hold period Tho. The switch control signal CSo is at high level during the charge period Tco and at low level during the hold period Tho. The write period of the data line $DE_1$ includes a charge period Tce and a hold period The. The switch control signal CSe is at high level during the charge period Tce and at low level during the hold period The.

During the charge period Tco, the switch control signals CSo and the gate signal GS1 are both at high level, thereby turning on the odd-numbered switch SWO and turning off the even-numbered switch SWE. Therefore, the data signal YO1 received by the data line $DO_1$ is equal to the data signal Y1 outputted by the switch control circuit 48, while the data line $DE_1$ is coupled to an equivalent high impedance. During the hold period Tho, the switch control signals CSo is at low level and the gate signal GS1 is at high level. Since the data line $DO_1$ is now coupled to equivalent high impedance, its data signal YO1 is no longer supplied by the data signal Y1, but is instead maintained by the inherent parasitic capacitance of the data line $DO_1$. Therefore, the data signal YO1 encounters a slight voltage drop ΔVo during the hold period Tho. Since the parasitic capacitance of the data line $DO_1$ is much larger than the liquid crystal capacitance of the display units, the voltage drop ΔVo is very small and only has negligible impact on data accuracy.

On the other hand, when the data line $DO_1$ enters the hold period Tho, the data line $DE_1$ enters the charge period Tce. The switch control signals CSe and the gate signal GS2 are both at high level, thereby turning off the odd-numbered switch SWO and turning on the even-numbered switch SWE. Therefore, the data signal YE1 received by the data line $DE_1$ is equal to the data signal Y1 outputted by the switch control circuit 48, while the data line $DO_1$ is coupled to an equivalent high impedance. During the hold period The, the switch control signals CSe is at low level and the gate signal GS2 is at high level. Since the data line $DE_1$ is now coupled to equivalent high impedance, its data signal YE1 is no longer supplied by the data signal Y1, but is instead maintained by the inherent parasitic capacitance of the data line $DE_1$. Therefore, the data signal YE1 encounters a slight voltage increase ΔVe during the hold period The. Since the parasitic capacitance of the data line $DE_1$ is much larger than the liquid crystal capacitance of the display units, the voltage increase ΔVe is very small and only has negligible impact on data accuracy.

In the present invention, each data signal is written into a corresponding first data line during the first period of a write period, and written into a corresponding second data line during the first period of the next write period. The alternations of outputting data signals continue until the end of a frame. Only one set of data lines among the first and second data lines receive data signals from the source driver at the same time, the other set of data lines not receiving data signals from the source driver maintain the current of the liquid crystal capacitors using the inherent large parasitic capacitance. Compared to the prior art, the present invention also charges the display units in two stages (the charge period and the hold period). However, since correct data signals are used in both stages, data accuracy of the current pixel is not affected by the data signal of the previous pixel. The present invention maintains the voltages levels during the hold period using the inherent parasitic capacitance of the data lines, and can thus increase the charge/discharge time of the liquid crystal capacitors. Meanwhile, the source driver 34 transmits m data signals Y1-Ym to 2 m data lines via the switch control circuit during corresponding periods. The present invention can thus reduce circuit layout area and lower power consumption.

Those skilled in the art will readily observe that numerous modifications and alterations of the device and method may be made while retaining the teachings of the invention.

What is claimed is:

1. A liquid crystal display (LCD) device capable of increasing charge time, comprising:

m first data lines disposed in parallel;

m second data lines disposed in parallel, wherein each second data line is disposed between two corresponding first data lines and parallel to the corresponding first data lines;

a plurality of parallel gate lines disposed perpendicular to the m first data lines and the m second data lines for receiving gate signals;

a plurality of first display units each coupled to a corresponding first data line among the m first data lines and to a corresponding gate line among the plurality of gate lines;

a plurality of second display units each coupled to a corresponding second data line among the m second data lines and to a corresponding gate line among the plurality of gate lines; and a source driver comprising:

a switch control circuit, comprising:

m input ends for respectively receiving the m data signals;

m first output ends respectively coupled to the corresponding m first data lines;

m second output ends respectively coupled to the corresponding m second data lines;

m first switches each comprising:

a first end coupled to a corresponding input end among the m input ends;

a second end coupled to a corresponding first output end among the m first output ends; and a control end for receiving a first control signal corresponding to the first and second periods; and m second switches each comprising:

a first end coupled to a corresponding input end among the m input ends;

a second end coupled to a corresponding second output end among the m second output ends; and a control end for receiving a second control signal corresponding to the first and second periods, wherein each data signal is outputted to a corresponding first data line among the m first data lines during a first period of a write period, and outputted to a corresponding second data line among the m second data lines during a second period of the write period.

2. The LCD device of claim 1 wherein the source driver further comprises:

a shift register for generating corresponding clock control signals based on clock signals and start pulse signals;

a data latch coupled to the shift register for generating corresponding sample data signals by latching data based on the timing signals;

a digital-to-analog converter (DAC) coupled to the data latch for converting the sample data signals to analog data signals; and an output buffer coupled between the DAC and the switch control circuit for outputting the m data signals to the switch control circuit based on the analog data signals.

3. The LCD device of claim 1 wherein the first and second switches include transistors.

4. The LCD device of claim 1 further comprising:

a gate driver coupled to the plurality of gate lines for providing the gate signals.

5. The LCD device of claim 1 wherein each display unit includes a thin film transistor (TFT) switch and a liquid crystal capacitor.

* * * * *